US007284347B2

(12) United States Patent
Rodrigues et al.

(10) Patent No.: US 7,284,347 B2
(45) Date of Patent: Oct. 23, 2007

(54) CHECKOUT DIVIDER

(75) Inventors: Claudio Rodrigues, Calgary (CA); Brad Wolff, Calgary (CA); Jill Rodrigues, Calgary (CA)

(73) Assignee: Retail Media Group, Calgary, AB (CA)

( * ) Notice: Subject to any disclaimer, the term of this patent is extended or adjusted under 35 U.S.C. 154(b) by 0 days.

(21) Appl. No.: 10/400,868

(22) Filed: Mar. 28, 2003

(65) Prior Publication Data

US 2003/0182836 A1 Oct. 2, 2003

Related U.S. Application Data

(60) Provisional application No. 60/367,762, filed on Mar. 28, 2002.

(51) Int. Cl.
*G09F 3/18* (2006.01)

(52) U.S. Cl. ..... 40/661; 40/124.06; 40/649; 40/672; 40/737; D20/40

(58) Field of Classification Search ..... 40/124.06, 40/124.11, 124.15, 649, 661, 672, 737; D20/40
See application file for complete search history.

(56) References Cited

U.S. PATENT DOCUMENTS 2,411,368 A * 11/1946 Dow ..... 206/103
2,490,638 A * 12/1949 Kubec ..... 40/737
2,811,796 A * 11/1957 Schoelles ..... 40/661
4,326,349 A * 4/1982 Daughtry ..... 40/733
4,534,126 A * 8/1985 Gilman ..... 40/661
4,663,872 A * 5/1987 Finger ..... 40/488
5,144,763 A * 9/1992 Calhoun ..... 40/506
5,272,826 A * 12/1993 Gingras ..... 40/661.01
5,450,926 A * 9/1995 Fraser ..... 186/59
5,456,033 A * 10/1995 Sachnoff ..... 40/661
D364,042 S * 11/1995 Chavez et al. ..... D6/314
5,485,694 A * 1/1996 Goad ..... 40/661
5,487,203 A * 1/1996 Brach et al. ..... 15/245
5,709,005 A * 1/1998 Brach et al. ..... 15/145
5,857,791 A * 1/1999 Kenney ..... 400/718
5,933,994 A 8/1999 Misaresh
6,148,960 A 11/2000 Fraser
6,263,603 B1 * 7/2001 Wildrick ..... 40/661
6,393,749 B1 * 5/2002 Haupt ..... 40/725
6,430,857 B1 * 8/2002 Nagel ..... 40/661

OTHER PUBLICATIONS

Beemak Plastics, Inc. AHS-F 6×4 Clear, http://www.beemak.net/cf/productdetail.cfm?thiscode=AHS-F+6×4&class=1.02&classname=Acrylic+Fabricated+Stock+Items, Nov. 21, 2001.*
Innovative Plastics, Table Tents, http://www.plasticfab.com/tabletent.htm, Dec. 29, 2001.*

* cited by examiner

*Primary Examiner*—Gary C. Hoge
(74) *Attorney, Agent, or Firm*—Sean W. Goodwin; Linda M. Thompson

(57) ABSTRACT

A transparent divider to be used at checkout conveyors for separating one customers order from the next customers order. The divider is an elongate bar which has an open bottom for ease of stacking or sliding along a checkout rail. A slot is formed in the side walls of the divider into which a sheet of printed advertisement can be folded and slid. The advertisement is visible, preferably on all side walls of the divider. The divider is available in a number of different shapes and can be made as a single piece or as an inner divider with a transparent cover.

17 Claims, 9 Drawing Sheets

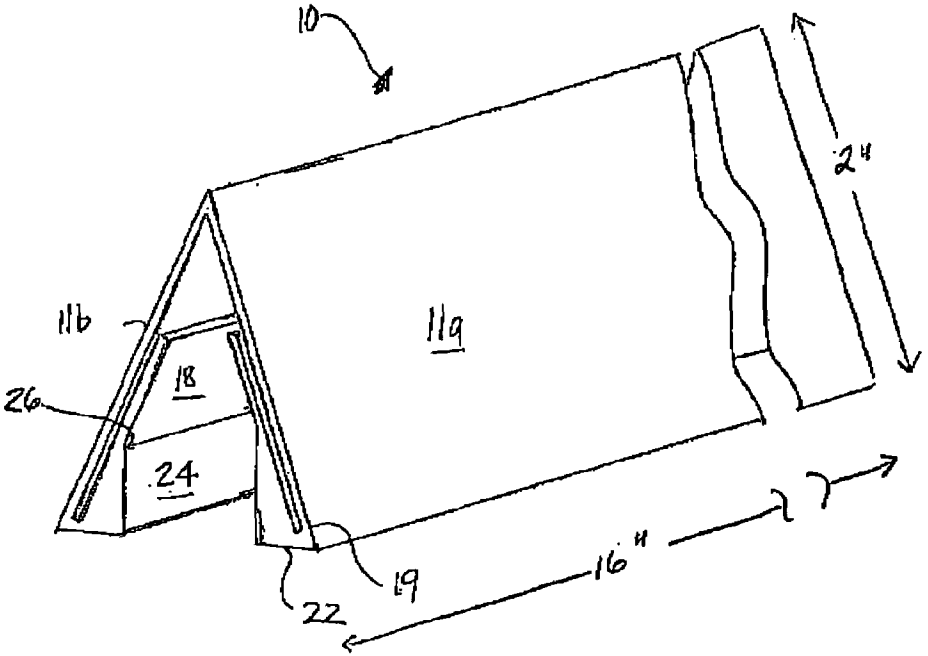
Fig. 2b
Fig. 2a
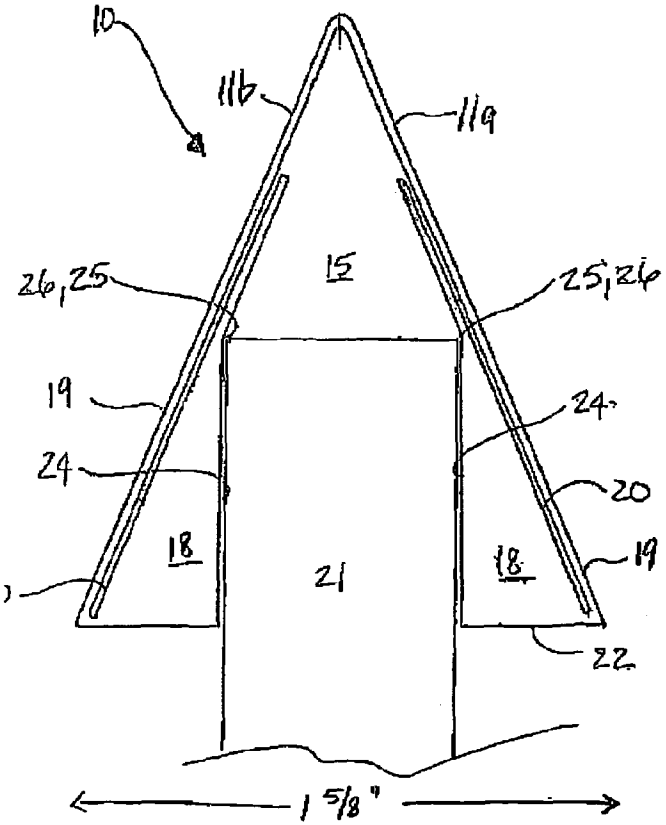

Fig. 4a
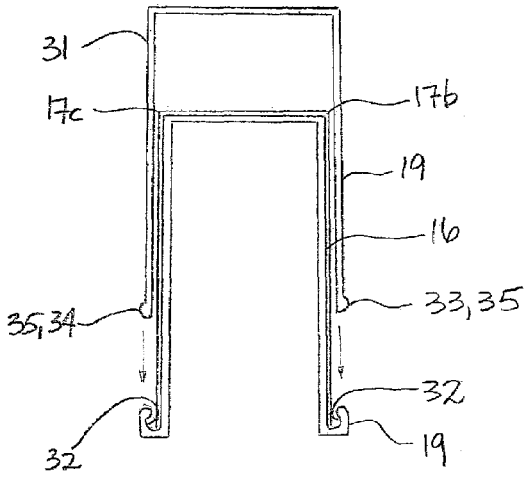
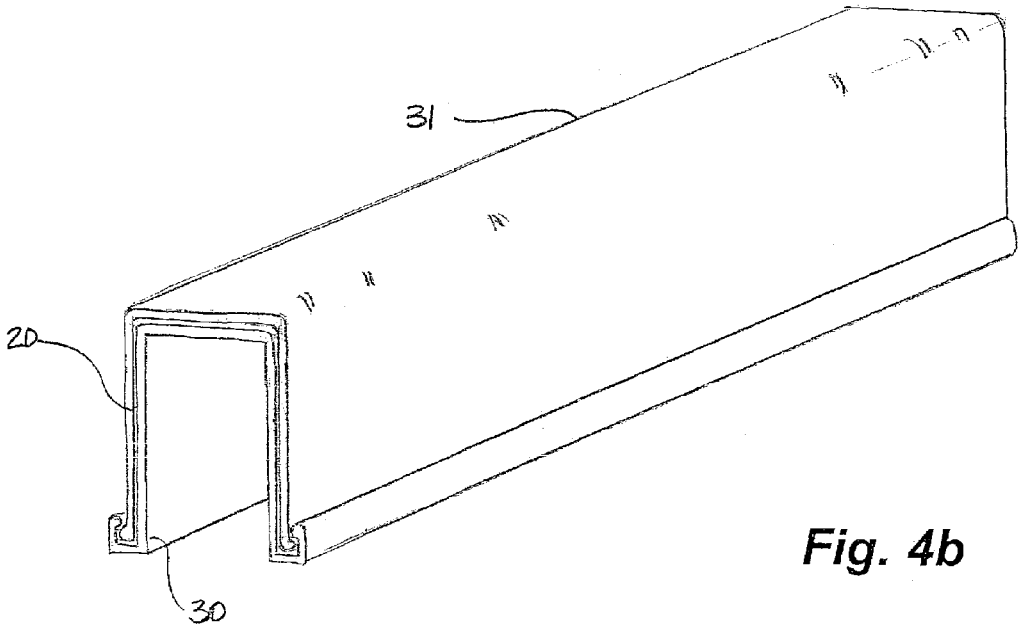
Fig. 4b

Fig. 5a
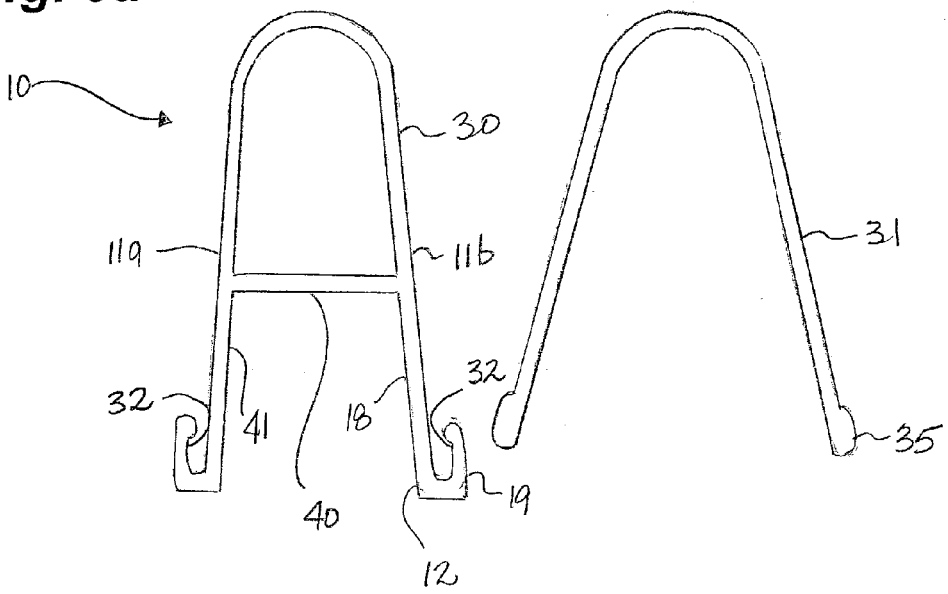
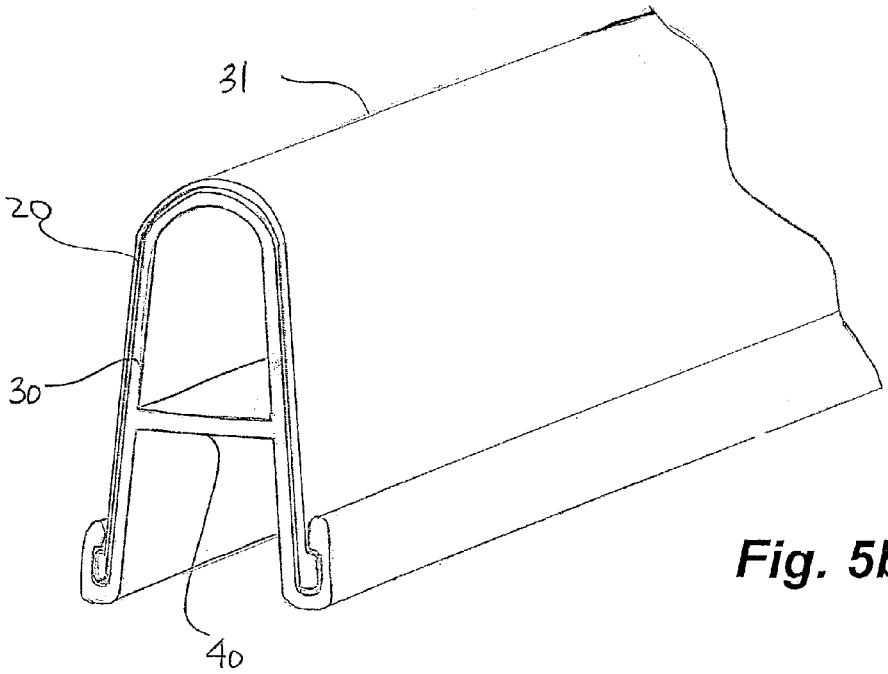
Fig. 5b

CHECKOUT DIVIDER

CROSS REFERENCE TO RELATED APPLICATION

This application is a regular application of U.S. Provisional patent application Ser. No. 60/367,762 filed on Mar. 28, 2002, the entirety of which is incorporated herein by reference.

FIELD OF THE INVENTION

The present invention relates to dividers used at conventional checkout conveyors to separate customer orders and more particularly to dividers that can also be used to display advertising.

BACKGROUND OF THE INVENTION

Commonly, in retail, dividers are provided at customer checkouts to separate individual customer's purchases. Typically, the dividers are placed on a checkout surface such as a conveyor belt, between the customer's purchases to indicate to the cashier where one order ends and the next begins.

For convenience, the dividers are often stored in a channel or over an edge of the conveyor adjacent the cashier so that when the cashier begins to ring in the next order the divider can be placed in the channel or over the edge and slid downwards towards the next customers in line.

Often, the dividers are imprinted with indicia which identifies the retail outlet or some other permanent type of advertising is imprinted directly onto the divider. With use, the advertising begins to fade or become damaged. When new advertising is required one must purchase new dividers.

Another type of divider is taught in U.S. Pat. No. 5,933,994 to Misaresh. The divider is a transparent fixture, having a plurality of embodiments of different cross-sections including square and triangular, and having two open ends and sides defining a hollow interior. Holders are formed having opposing pairs of slots in the hollow interior adjacent the top and bottom of each side to retain a plurality of strips of advertising therein. Individual planar strips having indicia printed thereon are slid into the paired top and bottom slots with the indicia visible through the transparent sides of the fixture. The planar strips are individually inserted and retained therein against the sides by flexible cylinders or end caps placed in the open ends. This is time consuming detailed work which is high in labor cost.

Clearly there is a need for a divider carrying advertising indicia wherein the indicia can be rapidly and simply changed, that has a simple construction to reduce production costs and that is capable of displaying indicia on a plurality of sides. Ideally, the indicia needs to be printed on a single sheet of material only, requiring a single insertion into the divider to minimize printing costs as well as labor costs.

SUMMARY OF THE INVENTION

The divider of the present invention comprises a transparent divider having two or more side walls defining a slot therebetween, an open bottom and open ends defining a hollow interior. A single sheet of material is printed with advertising indicia and is then folded at one or more predetermined positions for insertion into an open end of the slot in the divider. The folded sheet is either slid into the open end with the indicia oriented to be visible through the transparent side walls and is prevented from sliding out of the slot by friction or is placed over a first divider piece and then covered by a second transparent divider cover.

Further, the divider is sized so as to fit within a channel conveniently located at conventional checkout counters for the purpose, or alternatively over the edge of the checkout conveyer rails, and to provide optimum visible surface areas with the advertisement in an upright orientation. Conveniently, the dividers can be stacked as a result of the open side, which allows them to be easily collected and removed from use for changing the advertisement, either in the store or at a remote location.

In a broad aspect of the invention the transparent divider comprises an elongate member having at least two adjoining side walls, wherein each side wall comprises inner and outer walls for forming an elongate slot therebetween at least one outer wall of which is transparent, the slot being open at at least a first end for accepting an advertising sheet having indicia printed thereon, and wherein the adjoining side walls define an open bottom.

In a preferred embodiment of the invention the divider comprises a one-piece triangular divider wherein the inner wall extends, in a substantially parallel relationship to the outer wall, a least a portion of a height of the outer wall for forming the slot. The advertisement is preferably printed on a single sheet which is folded along the centre and then slid into the slot.

More preferably, the slot is narrowed at a top end by angling the inner wall slightly towards the outer wall for more firmly retaining the advertisement in the slot.

In a variation of the preferred embodiment, the inner portion of the divider is formed into a rectangular shape to permit fitting over and sliding upon the checkout conveyor rails. The inner wall extends a portion of the height of two opposing parallel outer walls.

In another embodiment of the invention, the divider is manufactured having a two-piece construction, A first divider piece, preferably either triangular, rectangular or "A"-shaped, is formed having the outer wall extending upwards a portion of the height of the inner wall for creating a slot, preferably shaped as a catch. A second transparent cover piece is formed having an identical shape to the divider and is sized to cover the first divider piece. The advertisement is folded and placed over the divider piece. The cover piece is then positioned over the advertisement and is engaged along longitudinal edges in the catch formed in the divider portion.

Preferably, the opposing longitudinal edges of the cover are formed having outwardly extending protrusions for engaging the opposing catches on the divider portion.

A yet another embodiment of the invention is provided wherein the divider is formed having unitary inner and outer walls. The walls are spaced from one another sufficient to allow a folded, single sheet of advertisement to be slid therebetween. Preferably, the third embodiment is triangular, rectangular or "A"-shaped.

BRIEF DESCRIPTION OF THE DRAWINGS

FIG. 2*a* is an end view of a variation of the first embodiment of the invention adapted to slide on conventional rectangular checkout rails;

FIG. 2*b* is a perspective view of the variation according to FIG. 2*a*;

FIG. 4*a* is an end view of a variation of the second embodiment of the present invention having a two-piece rectangular construction;

FIG. 4*b* is a perspective view according to FIG. 4*a*;

FIG. 5*a* is an end view of a variation of the second embodiment of the invention having a one piece construction and a horizontal wall forming a "A"-shape;

FIG. 5*b* is a perspective view according to FIG. 5*a*;

DESCRIPTION OF THE PREFERRED EMBODIMENT

Figure 1B:
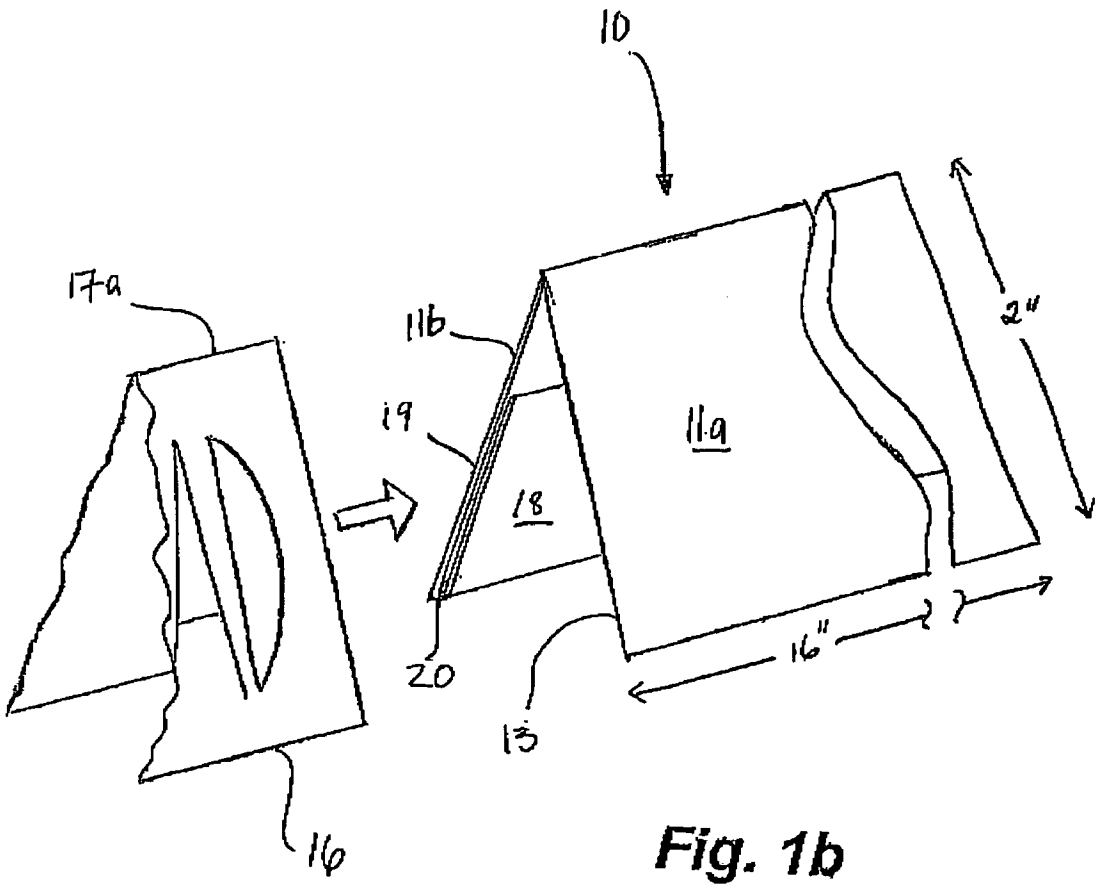
FIG. 1*b* is a side perspective view of the invention according to FIG. 1*a* illustrating insertion of a one-piece folded advertisement therein.
Figure 1A:
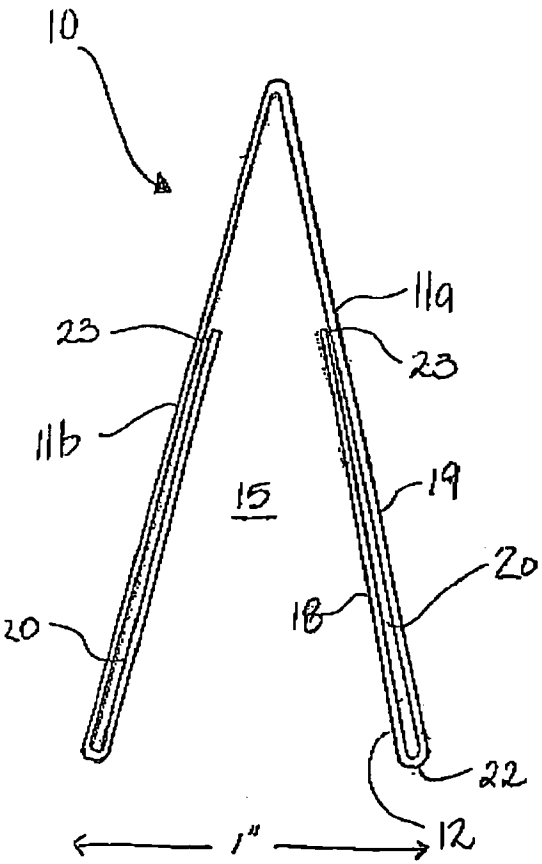
FIG. 1*a* is an end view of a first embodiment of the invention.

As shown in FIGS. 1*a*-8, the divider 10 of the present invention comprises a transparent elongate member or divider 10 having two or more adjoining side walls 11*a*, 11*b* . . . , an open bottom 12 and open ends 13,14 defining a hollow interior 15. The side walls 11*a*, 11*b* . . . are formed having an inner wall 18 and an outer wall 19 defining a slot 20 therebetween. Sheet material 16, preferably a single sheet, is printed with advertising indicia and is then folded at one or more predetermined positions 17*a*, 17*b* . . . for insertion into the slot 20 of the divider 10. At least the outer walls 19 of the divider 10 are transparent for viewing the advertisement. The folded sheet 16 is slid into the slot 20 with the indicia oriented to be visible through the transparent outer walls and is prevented from sliding out of the divider 10 by friction. Further, the divider 10 and the open bottom 12 are sized so as to fit within a channel conveniently located at conventional checkout counters (not shown) for the purpose, or alternatively over the edge of the checkout conveyer rails 21 (FIG. 2*a*), and to provide optimum visible surface areas with the advertisement in an upright orientation. Conveniently, the dividers 10 can be stacked as a result of the open bottom 12, which allows them to be easily collected and removed from use for changing the advertisement, either in the store or at a remote location.

Dividers 10 according to embodiments of the invention are sized so as to fit within channels which may be conveniently positioned adjacent the conveyor or over rails 21 along the checkout counter. An example of an exemplary divider 10 is a divider 10 of about one inch to about one and five-eighths inches in width, about sixteen inches in length and about two inches in height as shown in Applicant's US provisional application 60/327,762 incorporated herein by reference. One of skill in the art would understand that while the dimensions might vary slightly from this example, in order to permit the divider 10 to fit within the channel or over the rail and to be slid therealong and to divide between orders as described while remaining in an upright orientation to display the advertising therein, the dimensions do not vary so much as to affect the divider's ability to perform the functions for which it was designed.

In one embodiment of the invention as shown in FIGS. 1*a*-*b* and 2*a*-*b*, the slots 20 are formed towards the hollow interior 15 of the divider 10 and are formed by a base 22 and the inner wall 18 which may extend to varying heights in parallel and spaced relationship to the outer wall 19 forming slots 20 of varying depths.

Preferably, the base 22 and inner wall 18 are formed as a unitary structure and are contiguous with the outer walls 19.

More preferably, the inner wall 18 is angled slightly towards the adjacent outer wall 19 creating a narrowing of the slot 20 therebetween at a top 23 of the slot 20 to more firmly retain the advertisement sheet 16 therein.

FIGS. 1*a*-*b* and 2*a*-*b* illustrate the first embodiment having two side walls 11*a*, 11*b* and an open bottom 12 arranged in a triangular shape. In this variation, the advertisement 16 is sized to fit the two side walls 11*a*, 11*b*, is folded longitudinally along a center 17*a* and printed accordingly. The advertisement 16 is slid into an open end of the slot 20 of the divider 10 where it is engaged by friction.

Figure 1C:
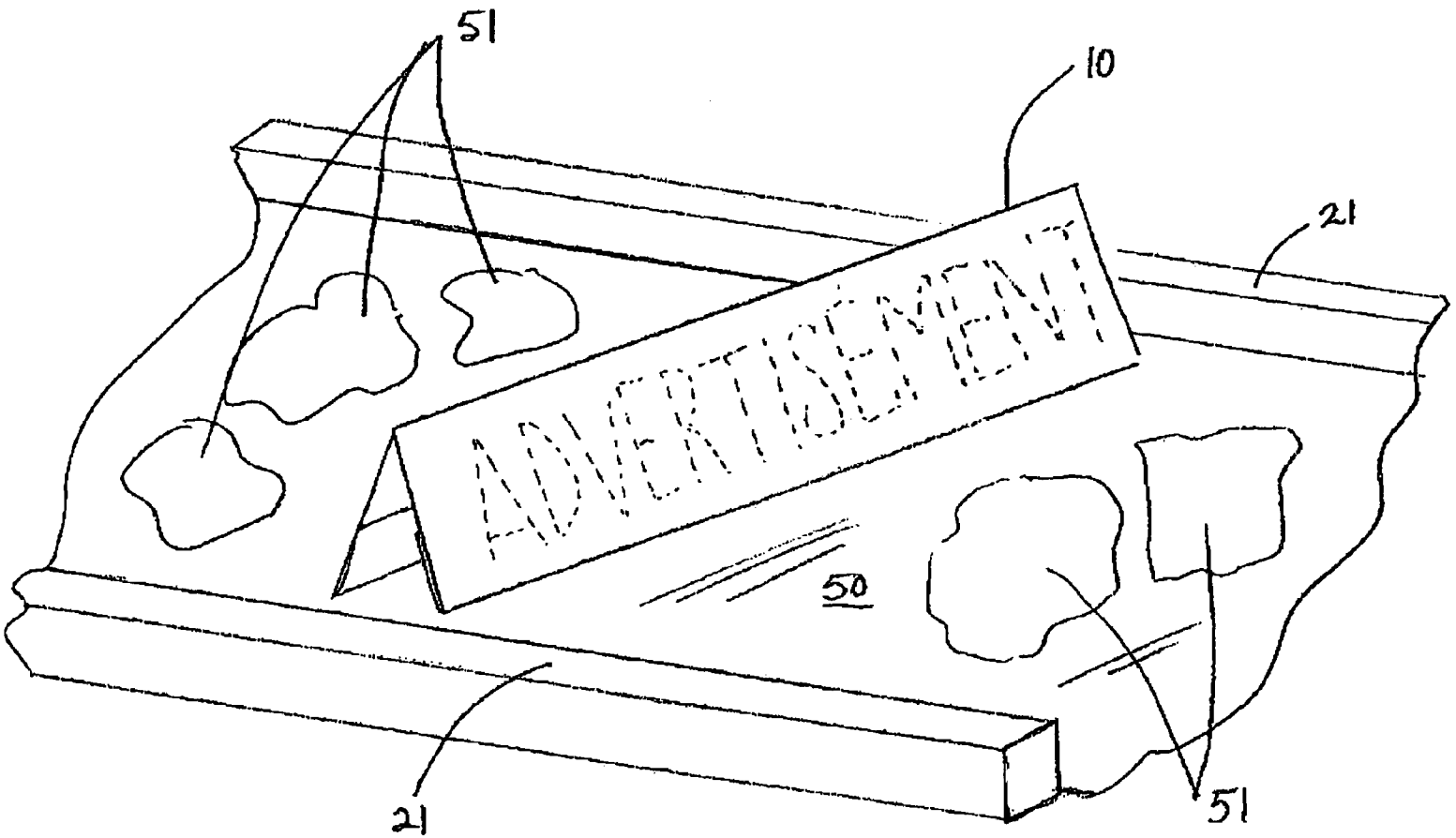
FIG. 1*c* is a perspective view of the embodiment according to FIG. 1*a*, shown on a checkout surface.

As shown in FIG. 1*c*, the divider 10 is positioned, in use, on a checkout surface 50 to divide or separate customer orders or items 51 placed thereon.

In a variation of the described embodiment, as shown in FIGS. 2*a*-*b*, the inner wall 18 is shaped to permit the divider 10 to be better positioned over a conveyer rail 21 when not in use. The inner wall 18 is thickened inward towards the hollow interior 15, adjacent the base 22, so as to cause inner surfaces 24 of the opposing inner walls 18 to be parallel to each other and complementary with a rectangular conveyor rail 21. The inner surface 24 extends upwards into the hollow interior 15 in spaced parallel relationship, the thickness of the inner wall 18 diminishing as the height increases. At a point 25 at which the thickness of the inner wall 18 is substantially equal to that of the outer wall 19, the inner wall 18 is angled to a parallel but spaced relationship to the outer wall 19. The point 25 at which the inner wall 18 deflects into parallel relationship with the outer wall 19 creates a shoulder 26 at which the conveyor rail 21 abuts and which the divider 10 is slideable thereon.

Having reference to FIGS. 3*a*-*b* to 5*a*-*b*, another embodiment of the divider 10, having a two-piece construction for holding a single advertisement sheet 16, folded longitudinally in order to be displayed on two or more side walls 11*a*, 11*b*, is shown. An inner divider piece 30 comprises the inner wall 18 and a partial outer wall 19 and a cover 31 completes the remainder of the outer wall 19. Both the divider piece 30 and the cover 31 are formed as described for the previous embodiment having two or more side walls 11*a*, 11*b* . . . , an open bottom 12 and open ends 13, 14. The partial outer wall 19 of the divider piece extends only a portion of a height of the inner wall 18, creating a longitudinal catch 32 thereon. The cover 31 is formed having an identical shape to the inner divider piece 30 and is sized so as to fit over the divider piece 30 and engage the longitudinal catch 32 on opposing side walls 11*a*, 11*b* of the divider piece 30. Once assembled the inner divider piece 30 and the cover 31 are spaced sufficient to define the slot 20 therebetween. At least the cover 31 of the divider 10 is transparent.

Preferably, first and second longitudinal edges 33, 34 of the cover 31 are formed having an outward protrusion 35 therealong for snap-fitting into the catch 32. Thus, the cover 31 is retained over the first divider piece 30. The advertisement 16 is folded and placed over the inner divider piece 30, after which the cover 31 is snapped into place. The cover 31 may be readily removed by forcing the protrusion 35 out of the catch 32 and the advertisement 16 changed at will.

Figure 3A:
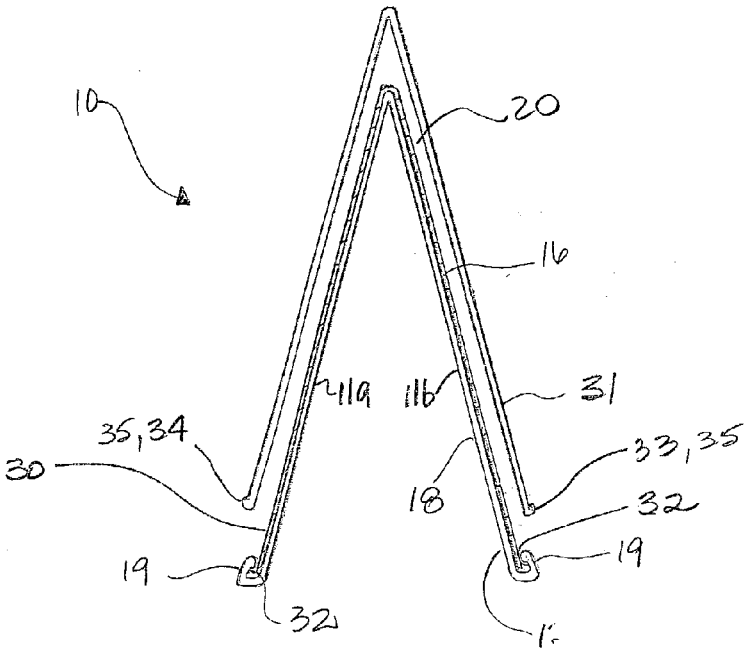
FIG. 3*a* is an end view of a second embodiment of the invention having a two piece triangular construction.
Figure 3B:
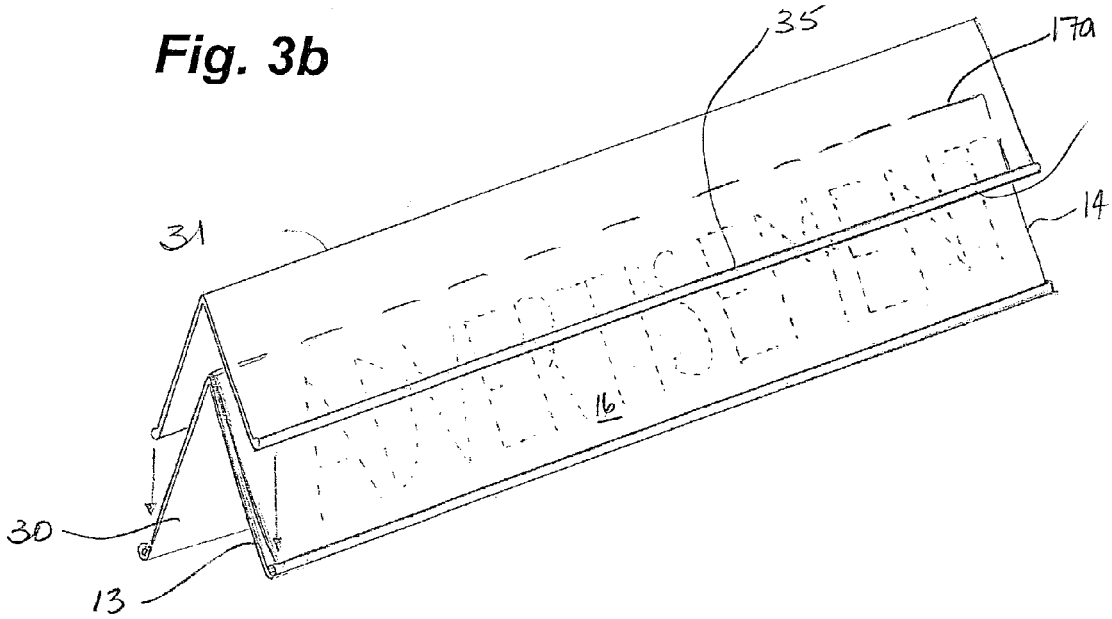
FIG. 3*b* is a perspective view of the second embodiment according to FIG. 3*a*.

FIGS. 3*a-b* illustrates a variation of the second embodiment wherein the inner divider piece 30 and cover 31 are triangular in shape. In this variation, the advertisement 16 is folded longitudinally at the centre 17*a* and is printed accordingly.

FIGS. 4*a-b* illustrates a variation of the two-piece embodiment wherein the inner divider piece 30 and cover 31 are rectangular in shape. In this variation, the advertisement 16 is folded longitudinally at two spaced places 17*b*, 17*c* on the sheet 16 and is printed accordingly.

FIGS. 5*a-b* illustrates another variation of the two-piece embodiment wherein the inner divider piece 30 is "A" shaped and the cover 31 is arch shaped. An interconnecting horizontal wall 40 is formed, parallel to the open bottom 12 and spanning the distance between the inner walls 18 substantially the length of the divider 10, for creating a rectangular hollow opening 41 adjacent the open bottom 12 of the divider 10. The rectangular hollow 41 allows the divider 10 to be positioned over the side rail 21 of a conveyor, the horizontal wall 40 providing a flat surface upon which the divider 10 can rest and be slid therealong.

Yet another embodiment of the invention is shown in FIGS. 6*a-b* and 7*a-b*. In this embodiment, the divider 10 is formed wherein the inner and outer walls 18, 19 are unitary. The walls 18, 19 are spaced from one another sufficient to create the slot 20 therebetween and allow the folded single sheet 16 of advertisement to be slid into the slot 20 as described in the previous embodiments.

Figure 6A:
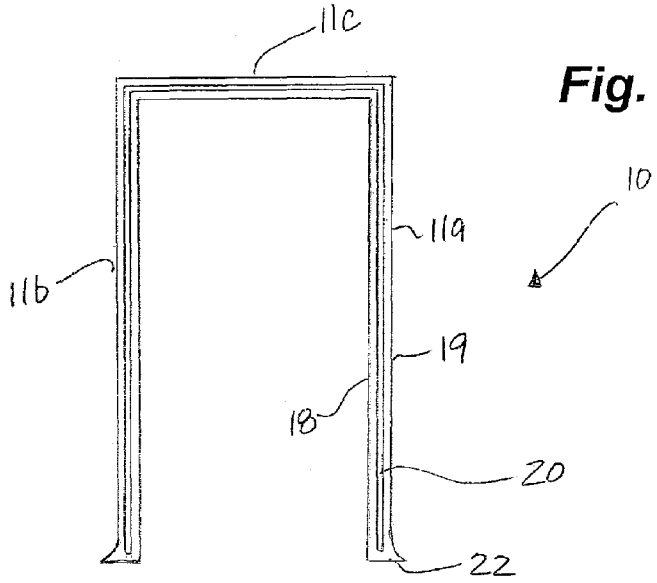
FIG. 6*a* is an end view of a third embodiment of the present invention having a once piece rectangular construction.
Figure 6B:
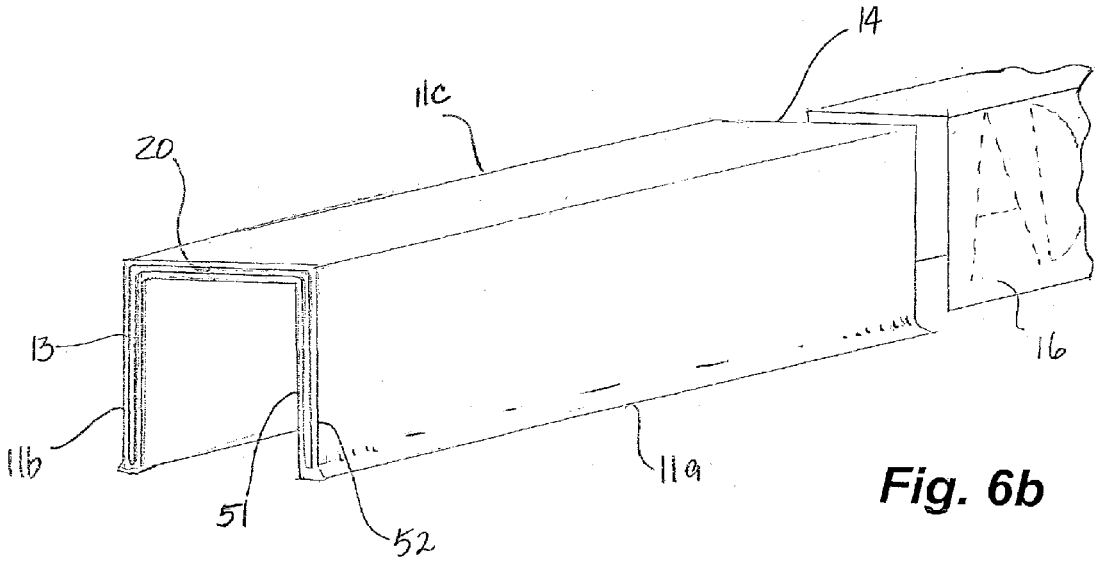
FIG. 6*b* is a perspective view according to FIG. 6*a*.

FIGS. 6*a-b* illustrates a variation of this embodiment wherein the divider 10 is rectangular in shape, having three adjoining side walls 11*a*, 11*b*, 11*c*. Other shapes such as triangular (not shown) are contemplated.

Preferably, the base 22 extends outwards from the outer wall 19 to provide additional stability to the divider 10 when positioned on a flat surface.

Figure 7B:
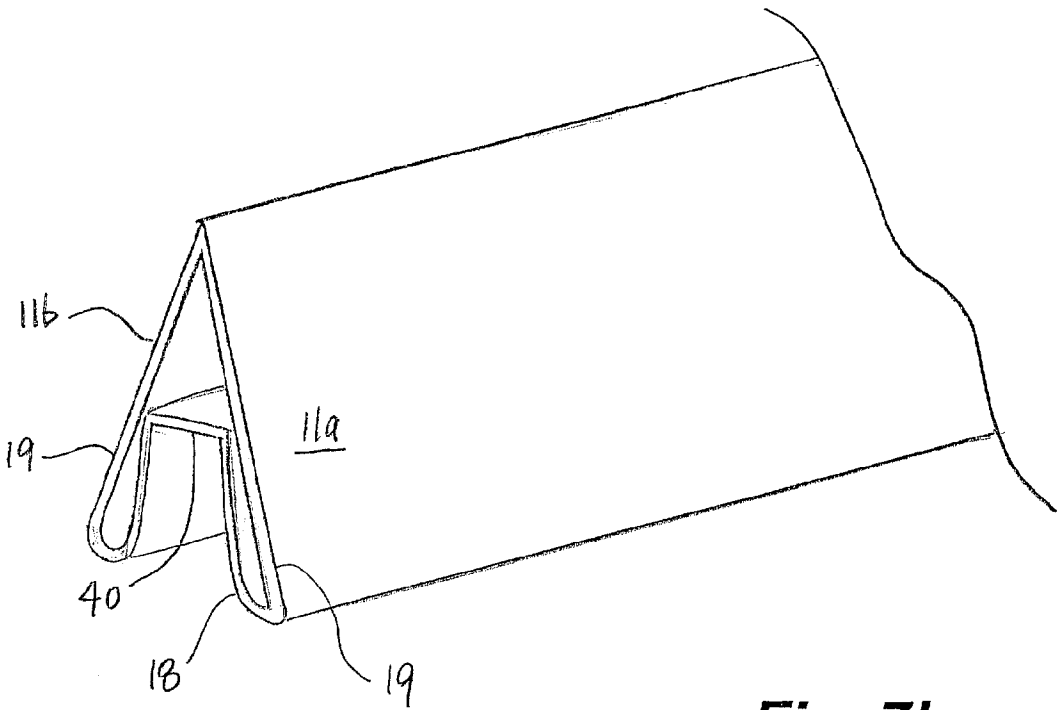
FIG. 7*b* is a perspective view according to FIG. 7*a*.
Figure 7A:
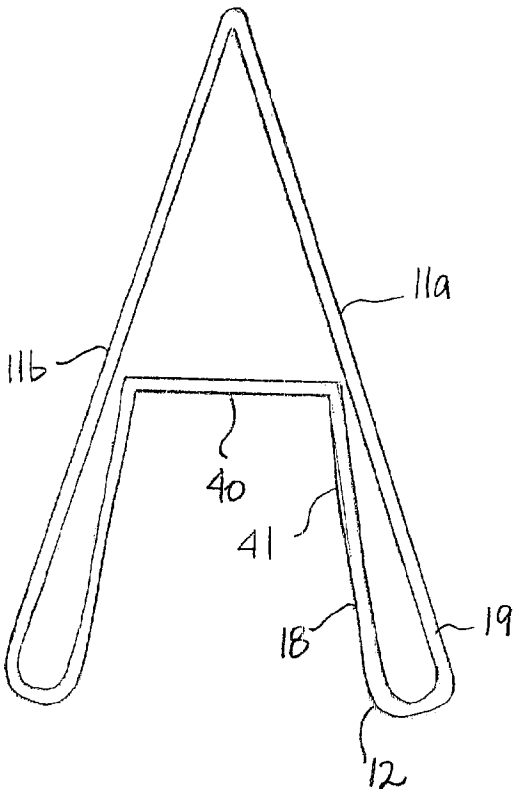
FIG. 7*a* is an end view of a variation of the third embodiment of the invention having a one piece triangular construction and a horizontal wall.
Figure 8:
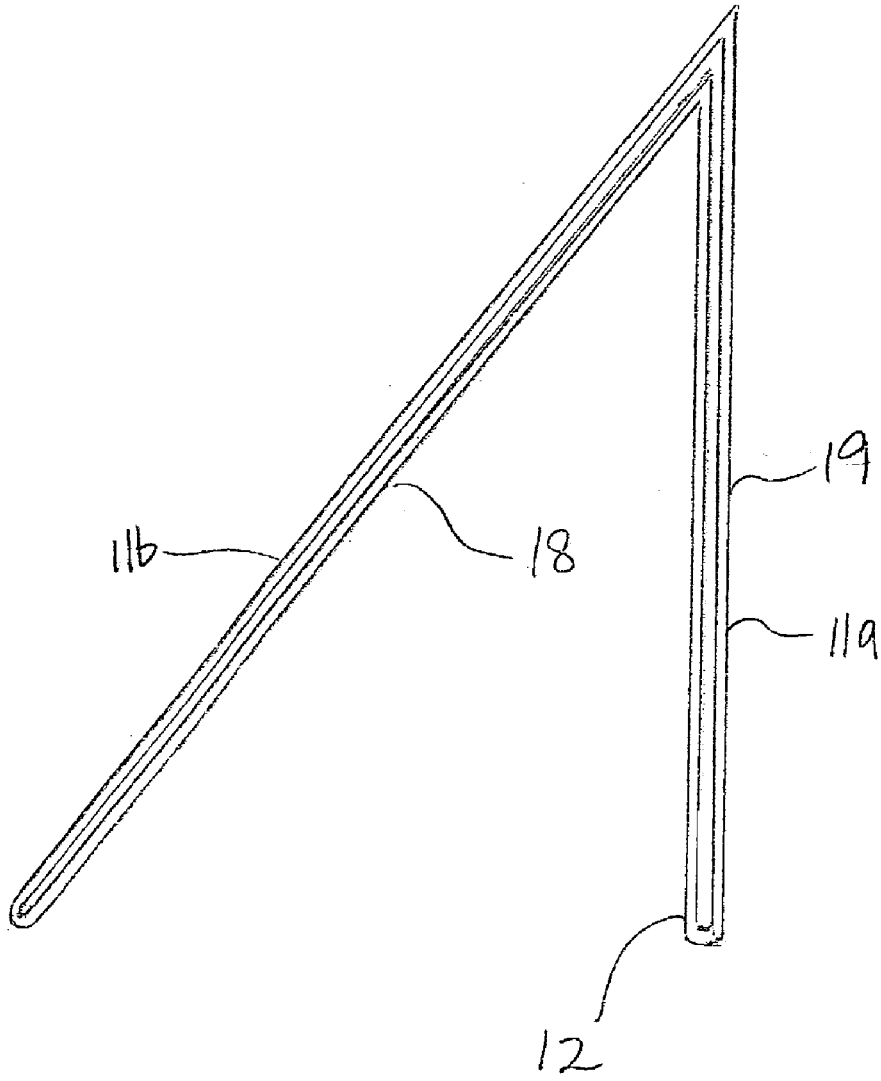
FIG. 8 is an end view of an alternate variation of the third embodiment of the invention having a one piece right-angled triangular construction.

FIGS. 7*a-b* and 8 illustrate another variation of this embodiment wherein the divider 10 is triangular in shape. In FIGS. 7*a-b*, the inner walls 18 further comprise a horizontal wall portion 40 parallel to the open bottom 12 and spanning the distance between the inner walls 18 substantially the length of the divider 10, for creating a rectangular hollow opening 41 adjacent the open bottom 12 of the divider 10.

FIG. 8 illustrates a right-angle triangular shape similar to the variation shown in FIG. 6*a-b*.

The embodiments of the invention in which an exclusive property or privledge is claimed are defined as follows:

1. A transparent checkout divider comprising, in combination:

a checkout surface upon which orders of items are supported and a checkout rail or a channel; and a checkout divider having an elongate member having at least two adjoining side walls and having a length about sixteen inches;

a closed top, being unitary with the at least two adjoining side walls, the divider having a height of about two inches; and a base formed along opposing longitudinal edges adjacent an open bottom, the base having a width of about one inch to about one and five-eighths inches;

wherein each side wall comprises inner and outer walls for forming an elongate slot therebetween and wherein the inner wall frictionally retains an advertisement sheet therebetween, at least one outer wall of which is transparent, the slot being open at at least a first end for removeably accepting an advertising sheet having indicia printed thereon, and wherein the adjoining side walls define the open bottom adapted for support over the checkout rail or within the channel.

2. The transparent checkout divider of claim 1 wherein the inner wall extends upwards from the base at least a portion of a height of the outer wall and in a spaced and substantially parallel relationship to the outer wall.

3. The transparent checkout divider of claim 2 wherein the base and the inner wall are unitary.

4. The transparent checkout divider of claim 2 wherein the inner wall is angled slightly toward the outer wall so as to approach the outer wall at a top end for frictionally retaining the advertisement sheet therebetween.

5. The transparent checkout divider as described in claim 2 wherein the outer wall extends upwards from the base at least a portion of a height of the inner wall and in a spaced and substantially parallel relationship to the outer wall for forming a longitudinal catch thereon and further comprises:

a transparent cover having a complementary shape and being sized to fit over the inner wall and engage the catch for forming the elongate slot therebetween.

6. The transparent checkout divider as described in claim 5 further comprising an outward protrusion formed along opposing lower longitudinal edges of the cover for snap-fitting into the opposing catches.

7. The transparent checkout divider of claim 1 comprising two side walls for forming a triangular shape.

8. The transparent checkout divider as described in claim 1 comprising three side walls for forming a rectangular shape.

9. The transparent checkout divider as described in claim 1 further comprising a horizontal wall parallel to the open bottom and spanning a distance between two opposing inner side walls, substantially a length of the divider, for creating a rectangular hollow opening adjacent the open bottom of the divider.

10. The transparent checkout divider of claim 1 wherein the unitary inner and outer walls are arranged in a triangular shape.

11. The transparent checkout divider as described in claim 1 wherein the unitary inner and outer walls are arranged in a rectangular shape.

12. The transparent checkout divider as described in claim 1 wherein the unitary inner and outer walls are arranged in an A shape.

13. The transparent checkout divider of claim 1 wherein the elongate member is triangular in shape and wherein the advertising sheet is folded along a centre for insertion into the elongate slot at at least the first open end.

14. The transparent checkout divider of claim 1 wherein the open bottom of the checkout divider is stackable over the closed top of another of the checkout dividers.

15. A system for dividing consumers' grocery orders on a checkout surface comprising:

a checkout divider comprising an elongate member having a length of about 16 inches, operative to divide grocery orders on the checkout surface, the checkout divider having at least two adjoining transparent side walls, a closed top being unitary with the at least two adjoining side walls and forming a base formed along opposing longitudinal edges adjacent an open bottom for supporting the checkout divider on the checkout surface and wherein each side wall comprises inner and outer walls for forming an elongate slot therebetween and open at at least one open end, the divider having a height of about two inches and a width at the base of about one inch to about one and five-eighths inches;

advertising sheets replaceably fit into the at least one open end of the elongate slot and retained frictionally therein by the inner and outer walls; and a checkout rail adjacent a side of the checkout surface for access by consumers wherein checkout dividers can be stored temporarily on the checkout rail and slidable therealong with the open bottom straddling the rail when not dividing grocery orders.

16. The system of claim 15 wherein the elongate member is triangular in shape and wherein the advertising sheet is folded along a centre for insertion into the elongate slot at at least the first open end.

17. The system of claim 15 further comprising a plurality of advertising sheets adapted for rapid replacement of advertised indicia.

* * * * *